US008739482B1

(12) United States Patent
Feil, III et al.

(10) Patent No.: US 8,739,482 B1
(45) Date of Patent: Jun. 3, 2014

(54) FIRESTOPPING APPARATUS WITH AIRFLOW-BLOCKING ELEMENTS

(71) Applicant: 3M Innovative Properties Company, St. Paul, MN (US)

(72) Inventors: William J. Feil, III, Woodbury, MN (US); Andrew H. Tilstra, Shoreview, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/826,591

(22) Filed: Mar. 14, 2013

(51) Int. Cl.
*E04B 1/94* (2006.01)

(52) U.S. Cl.
USPC ..... 52/220.8; 52/317

(58) Field of Classification Search
CPC ..... E04B 2/7411; E04B 2/7412
USPC ..... 52/1, 220.8, 232, 317
See application file for complete search history.

(56) References Cited

U.S. PATENT DOCUMENTS

| | | | | |
|---|---|---|---|---|
| 4,136,707 | A | 1/1979 | Gaillot | |
| 5,421,127 | A * | 6/1995 | Stefely | 52/1 |
| 5,548,934 | A | 8/1996 | Israelson | |
| 6,928,777 | B2 | 8/2005 | Cordts | |
| 7,114,303 | B2 | 10/2006 | Cordts | |
| 7,523,590 | B2 | 4/2009 | Stahl, Sr. | |
| 8,069,623 | B2 | 12/2011 | Colwell | |
| 2004/0016193 | A1 | 1/2004 | Stahl | |
| 2010/0326678 | A1 | 12/2010 | Monden | |
| 2011/0094759 | A1 | 4/2011 | Lopes | |

* cited by examiner

*Primary Examiner* — Jeanette E Chapman
*Assistant Examiner* — Daniel Kenny
(74) *Attorney, Agent, or Firm* — Kenneth B. Wood

(57) ABSTRACT

A firestopping apparatus including a sleeve with at least first and second airflow-blocking elements, with at least the first airflow-blocking element comprising a resiliently compressible body and being slidably movable generally along a long axis of the sleeve.

20 Claims, 8 Drawing Sheets

FIRESTOPPING APPARATUS WITH AIRFLOW-BLOCKING ELEMENTS

BACKGROUND

Elongate tubes and the like are often passed through openings that penetrate e.g. through the interior walls of buildings. In the process of firestopping such through-penetrating openings, it is common practice to place the tube or tubes in a sleeve and to provide a firestop material, e.g., an intumescent material, within the sleeve.

SUMMARY

In broad summary, herein is disclosed a firestopping apparatus comprising a sleeve with at least first and second airflow-blocking elements, with at least the first airflow-blocking element comprising a resiliently compressible body and being slidably movable in a first direction generally along the long axis of the sleeve. These and other aspects of the invention will be apparent from the detailed description below. In no event, however, should this broad summary be construed to limit the claimable subject matter, whether such subject matter is presented in claims in the application as initially filed or in claims that are amended or otherwise presented in prosecution.

Like reference numbers in the various figures indicate similar or like elements, and/or concepts that are common to multiple figures. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", bottom", "upper", lower", "under", "over", "front", "back", "up" and "down", and "first" and "second" may be used in this disclosure, it should be understood that those terms are used in their relative sense only unless otherwise noted. The terms forward and rearward respectively indicate directions generally along the long axis of elongated sleeve 20 away from, and toward, the long-axis centerpoint of elongated sleeve 20.

As used herein as a modifier to a property or attribute, the term "generally", unless otherwise specifically defined, means that the property or attribute would be readily recognizable by a person of ordinary skill but without requiring absolute precision or a perfect match (e.g., within +/−20% for quantifiable properties). The term "substantially", unless otherwise specifically defined, means to a high degree of approximation (e.g., within +/−10% for quantifiable properties) but again without requiring absolute precision or a perfect match. Terms such as same, equal, uniform, constant, completely, strictly, and the like, are understood to be within the usual tolerances or measuring error applicable to the particular circumstance rather than requiring absolute precision or a perfect match.

DETAILED DESCRIPTION

Figure 1:
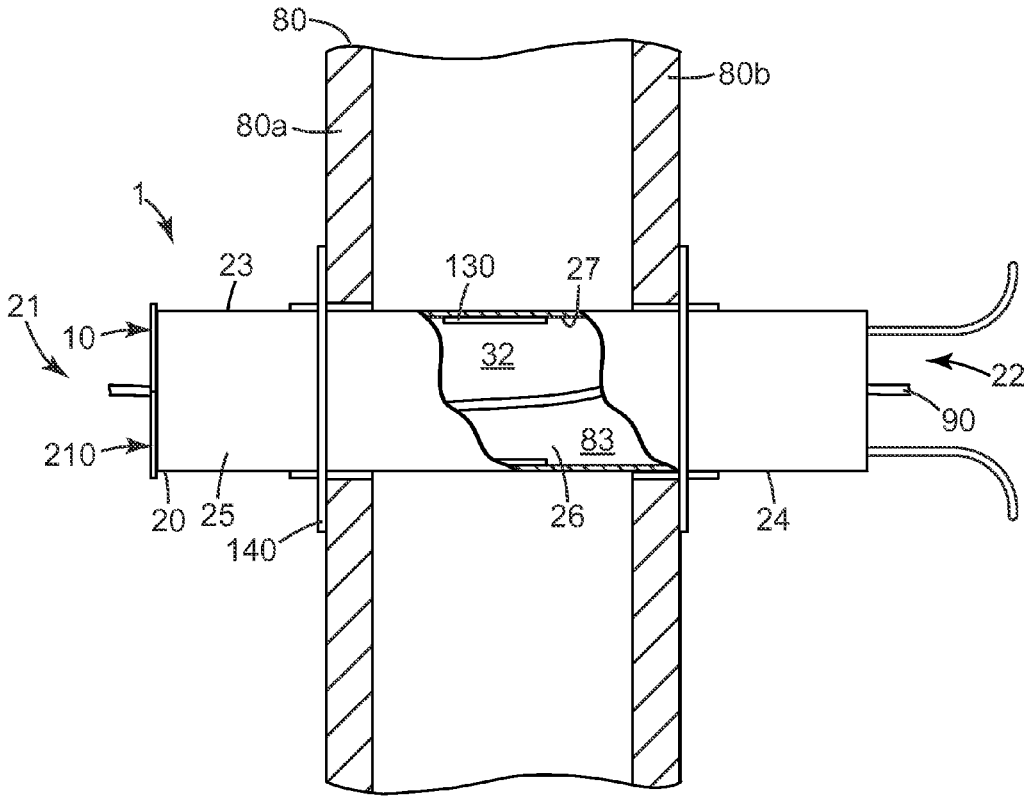
FIG. 1 is a side schematic view in partial cutaway of an exemplary firestopping apparatus, mounted in a through-penetrating opening in a wall.

Shown in FIG. 1 in side schematic view in partial cutaway is an exemplary firestopping apparatus 1 that may be useful in the firestopping of a through-penetrating opening 83, e.g., in a wall of a building. In the present context, the term wall is used broadly to include vertical walls as well as horizontal floors/ceilings, etc. While the particular wall 80 shown in FIG. 1 comprises two partitions 80*a* and 80*b*, separated from each other by a cavity space established e.g. by a stud (in which case opening 83 would comprise aligned openings in partitions 80*a* and 80*b* respectively), wall 80 may comprise a single partition and may or may not comprise features such as studs etc. Wall 80 and/or partitions thereof may be comprised of commonly known building materials such as gypsum, wood, plaster, concrete, and the like.

Apparatus 1 comprises an elongated, open-ended sleeve 20 that defines interior space 32 therewithin, and that comprises a long axis that may be conveniently aligned with the direction that through-penetrating opening 83 extends through wall 80. Interior space 32 of sleeve 20 is configured so that at least one elongate tube 90 may be passed therethrough (with one elongate tube 90 being shown passed through space 32 of sleeve 20 in FIG. 1). In some embodiments, sleeve 20 may comprise at least one piece of firestop material 130 as depicted in exemplary manner in FIG. 1. In specific embodiments, such a piece of firestop material 130 may be provided e.g. as a sheetlike slab or pad that is positioned along a major inside surface 27 of sleeve 20. In some embodiments, such a piece of firestop material may comprise an intumescent composition so that if activated (e.g. by heat) the firestop material may expand so as to partially or completely block the passage of flame, hot gases, smoke, etc. through sleeve 20. In further embodiments, a second such piece of firestop material may be provided e.g. on a generally oppositely-facing inner wall from the first piece, so that one or more elongate tubes 90 can pass therebetween and so that if activated and expanded, the two firestop pieces may expand generally towards each other. However, it will be appreciated that such firestop material, if present, can be provided at any suitable location within sleeve 20, and in any suitable form, geometry, and number of pieces. If desired, one or more cover plates 140 can optionally be provided as shown in exemplary embodiment in FIG. 1. Such an arrangement may e.g. enhance the securing of sleeve 20 to wall 80 and/or minimize the chance of any airflow pathway being present around the exterior of sleeve 20. (Caulk, putty or any other suitable space-filling material may also be placed around the exterior of sleeve 20, if desired.)

Sleeve 20 comprises first and second open ends 21 and 22 as shown in FIG. 1 (it being understood that the term open-ended applies to sleeve 20 itself, irrespective of the fact that airflow through sleeve 20 may be at least partially blocked at times by airflow-blocking elements as described herein). Apparatus 1 further comprises first and second airflow-blocking elements 10 and 210, as shown in representative example in various Figures. These airflow-blocking elements (e.g. when in a closed position) may serve to partially or completely block the passage of air, hot gases, smoke, etc. through sleeve 20, prior to the activation of a firestop material (if present) of sleeve 20. That is, such elements may minimize the chance of any hot gases or smoke arising from a fire from penetrating through sleeve 20 prior to the time that the heat generated from the fire is sufficient to activate the firestop material.

First and second airflow-blocking elements 10 and 210 may be positioned proximate first open end 21 of sleeve 20 (e.g., so that they will not interfere with any expansion of firestop material 130). At least first airflow-blocking element 10 is slidably movable in a first direction generally along the long axis of open-ended sleeve 20 toward a long-axis centerpoint of the open-ended sleeve (e.g., toward the right in FIG. 2). The moving of first airflow-blocking element 10 in the first direction generally along the long axis of open-ended sleeve 20, urges at least a portion of a first resiliently compressible body 13 of first airflow-blocking element 10 in a first actuation direction along an actuation axis, toward a first, blocking position in which a first mating surface 17 of first resiliently compressible body 13 is proximate to a second mating surface 217 of second airflow-blocking element 210. At least first airflow-blocking element 10 is also slidably movable in a second actuation direction that is generally opposite the first direction, away from the long-axis centerpoint of open-ended sleeve (e.g., toward the left in FIG. 2), which moving of first airflow-blocking element 10 in the second direction generally along the long axis of open-ended sleeve 20, urges at least a portion of the first resiliently compressible body 13 of first airflow-blocking element 10 in a second direction along the actuation axis, toward a second, open position in which the first mating surface 17 of the first resiliently compressible body 13 is separated from the second mating surface 217 of the second airflow-blocking element 210. Such an actuation axis may be at least generally orthogonal to the long axis of elongated sleeve 20.

Figure 3:
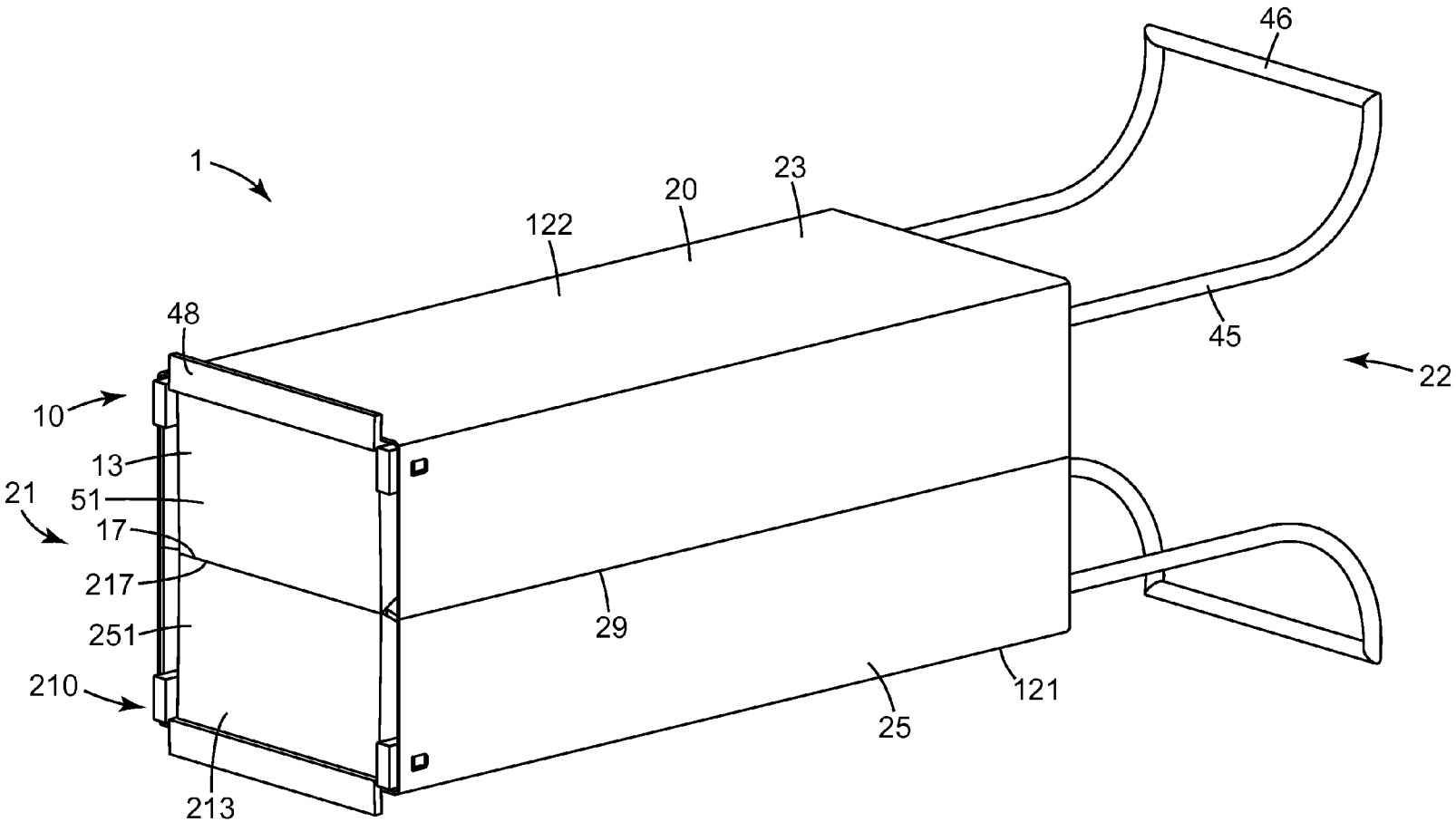
FIG. 3 is a front-side perspective view of an exemplary firestopping apparatus with airflow-blocking elements in a closed position.
Figure 4:
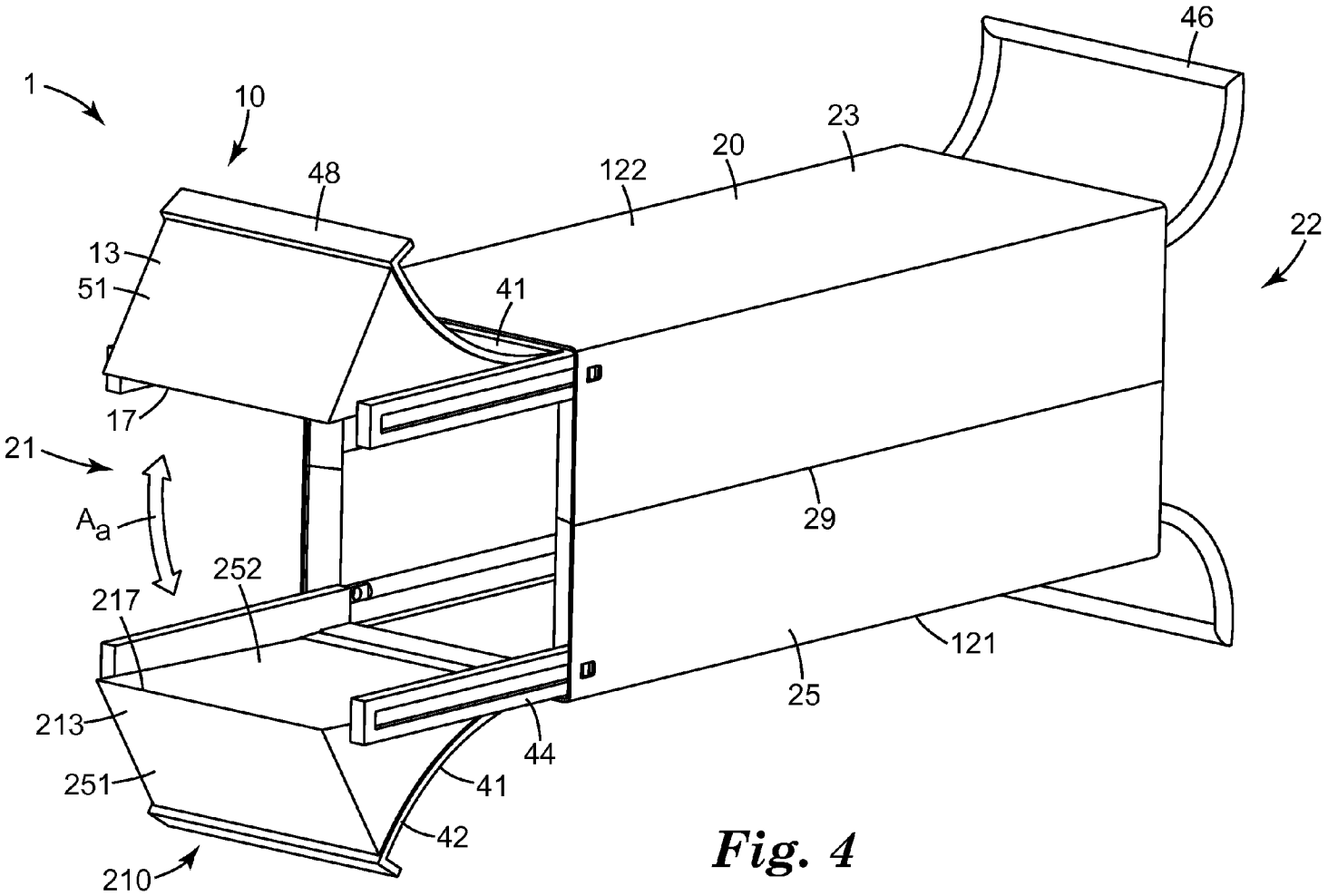
FIG. 4 is a front-side perspective view of an exemplary firestopping apparatus with airflow-blocking elements in an open position.

These principles are illustrated in exemplary embodiment in FIGS. 3 and 4, with FIG. 3 showing first airflow-blocking element 10 (along with second element 210) having been moved to a closed position, and with FIG. 4 showing first airflow-blocking element 10 (again, along with second element 210) having been moved to an opened position. Actuation axis $A_a$, along which at least a portion of first resiliently compressible body 13 of first airflow-blocking element 10 may move in response to the aforementioned moving of first element 10 generally along the long axis of sleeve 20, is also shown in FIG. 4. In the exemplary embodiments of FIGS. 3 and 4, second airflow-blocking element 210 is movable in like manner to first airflow-blocking element 10 (e.g. so as to move in concert with first element 10). That is, in the illustrated embodiment second airflow-blocking element 210 is movable generally along the long axis of sleeve 20, which moving causes at least a portion of a second resiliently compressible body 213 of second element 210 to move along actuation axis $A_a$ (e.g., so that first and second resiliently compressible bodies 13 and 213 may open away from each other, and close toward each other, in similar manner to a pair of jaws, as first and second elements 10 and 210 are slidably moved back and forth generally along the long axis of sleeve 20). However, second element 210 does not necessarily have to be movable in the exact same manner as first element 10.

By a closed position is meant that first mating surface 17 of first resiliently compressible body 13 of first airflow-blocking element 10 at least closely abuts a second mating surface 217 of second airflow-blocking element 210 (e.g., of a second resiliently compressible body 213 of element 210), excepting locations where an elongate tube 90 is present therebetween. As used herein, to closely abut (as applied to any two items mentioned herein) means to approach to within an average distance of 2 mm or less. In various embodiments, any two items that are stated herein to at least closely abut each other may approach each other to an average distance of less than 1 mm, 0.5 mm, or 0.2 mm. In specific embodiments such items may contact each other as will be evident from discussions later herein.

By an open position is meant that first mating surface 17 of first resiliently compressible body 13 of first airflow-blocking element 10 is, on average, at least 1 cm away from second mating surface 217 of second airflow-blocking element 210 (thus, in such a configuration, one or more elongate tubes 90 can be conveniently passed therebetween). It will be appreciated that elements 10 and 210 may assume partially closed positions in between the open and closed position, as discussed later herein.

With reference to the exemplary illustration of FIG. 4, at least the first resiliently compressible body 13 of first airflow-blocking element 10 may be biased (e.g., by biasing sheet 41 as discussed in detail later herein), which biasing force urges at least a portion of body 13 in the second actuation direction (i.e., toward the second, open position) along actuation axis $A_a$. In some embodiments, actuation axis $A_a$ may be arcuate as shown in FIG. 4. The above-disclosed arrangements thus allow at least a portion of first resiliently compressible body 13 of first airflow-blocking element 10 to be moved along actuation axis $A_a$ in a direction away from second airflow-blocking element 210, by way of moving element 10 in a direction at least generally aligned with the long axis of sleeve 20. To facilitate this moving of element 10, in at least some embodiments first airflow-blocking element 10 may be connected to at least one pushrod 45, which pushrod(s) 45 may be connected to a handle 46 that e.g. protrudes outward from second open end 22 of sleeve 20, as shown in exemplary embodiment in FIGS. 1-4 and as discussed in further detail herein.

Figure 2:
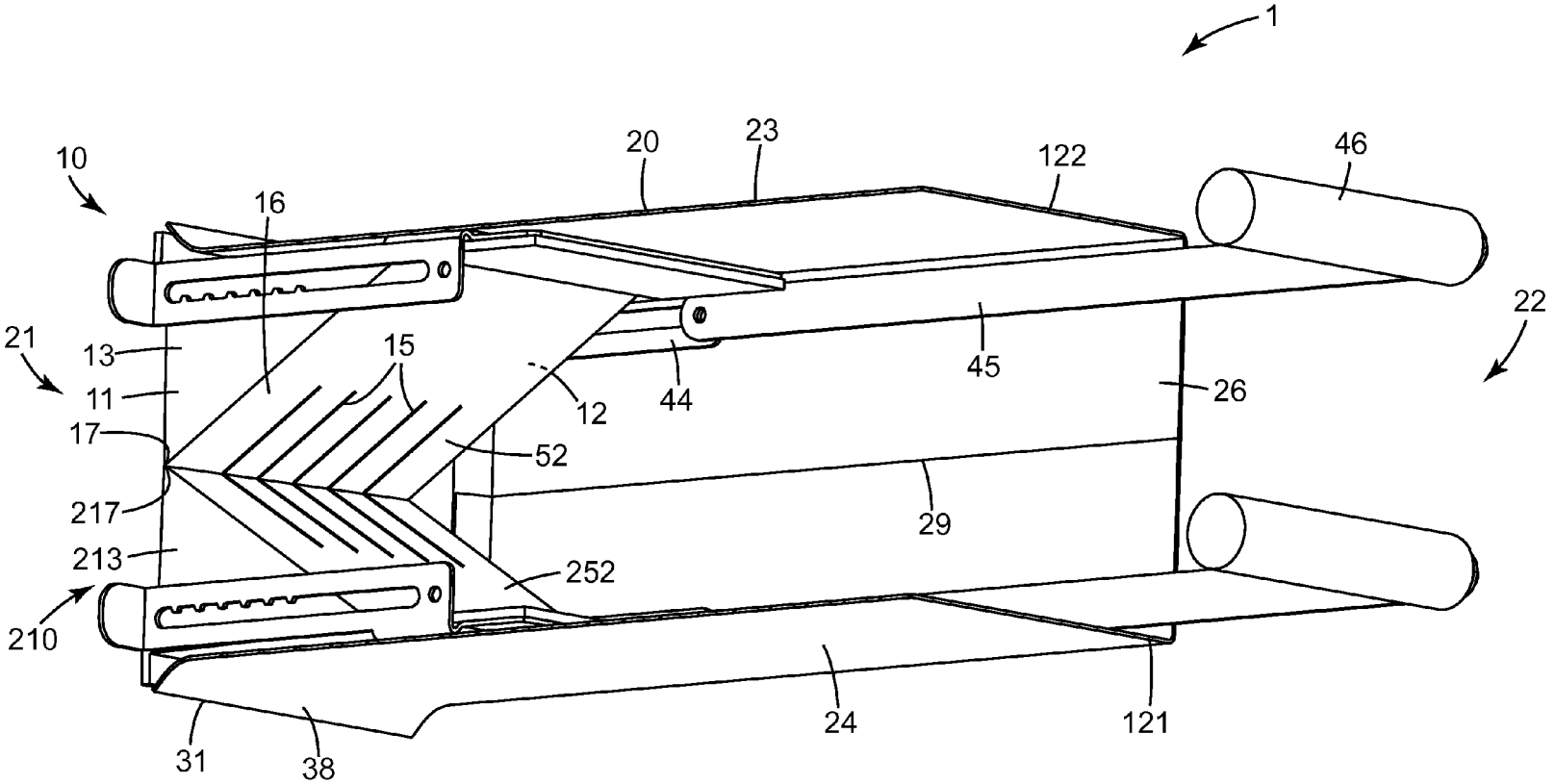
FIG. 2 is a side-rear perspective view in cutaway of an exemplary firestopping apparatus.

In at least some embodiments, elongated, open-ended sleeve 20 comprises sidewalls as referred to above. The term primary sidewalls is used herein to denote sidewalls toward which, and away from which, first airflow-blocking element 10 can move along actuation axis $A_a$. In FIGS. 1 and 2, first primary sidewall 23 is the sidewall toward which first airflow-blocking element 10 moves when it moves away from second airflow-blocking element 210; second primary sidewall 24 is the sidewall toward which first airflow-blocking element 10 moves when it moves toward second airflow-blocking element 210. The term transverse sidewalls is used to denote sidewalls that are oriented at least generally parallel to actuation axis $A_a$ (and that are at least generally orthogonal to primary sidewalls 23 and 24). Exemplary first transverse sidewall 25 and second transverse sidewall 26 are shown in FIG. 1 (with a portion of first transverse sidewall 25 cut away to show the interior of sleeve 20); a second transverse sidewall 26 is likewise visible in FIG. 2, with first transverse sidewall 25 having been omitted in this view to better show the interior of sleeve 20.

Sleeve 20 thus has a transverse axis that extends between transverse sidewalls 25 and 26 of sleeve 20, which transverse axis is oriented at least generally orthogonally to actuation axis $A_a$ (and is oriented at least generally orthogonally to the long axis of sleeve 20). In some embodiments, first airflow-blocking element 10 may extend at least generally along the transverse axis of sleeve 20 so as to comprise a first transverse end 11 that is proximate first transverse sidewall 25 of sleeve 20, and a second transverse end 12 that is proximate second transverse sidewall 26 of sleeve 20. (Transverse ends 11 and 12 of first airflow-blocking element 10 are most easily seen e.g. in FIG. 2). In some embodiments, first transverse end 11 of first airflow-blocking element 10 at least closely abuts first transverse sidewall 25 of sleeve 20 and second transverse end 12 of first airflow-blocking element 10 at least closely abuts second transverse sidewall 26 of sleeve 20.

Resiliently compressible body 13 of first airflow-blocking element 10 may be comprised of any suitable material that is sufficiently resiliently compressible and that provides a satisfactory barrier to air flow, either alone or in combination with a barrier layer as disclosed below. Such a resiliently compressible material might be e.g. an elastomeric foam, such as foam rubber, sponge, or the like. In some embodiments, the material may have closed cells; however, in other embodiments the material may be an open-cell material e.g. if the cell walls provide, in the aggregate, a sufficient barrier to air flow through the material. If the material has a surface skin (e.g. that provides an outer surface of resiliently compressible body 13) that provides an airflow barrier, the internal airflow resistance of the material may be immaterial. Likewise, in some embodiments, an airflow-barrier layer (e.g. in the form of a thin layer, e.g. a film or foil) may be applied to an outermost surface of body 13.

In various embodiments, body 13 may be a resiliently compressible polymeric foam or sponge (e.g., a polyurethane foam or any other suitable polymeric foam) with a density of no greater than about 150, 100, 50, or 20 kilogram per cubic meter. If desired, empty cavities, void spaces, or the like (e.g., cut-outs) may be provided e.g. within the interior of body 13 so as to enhance the resilient compressibility thereof. In some embodiments, at least first airflow-blocking element 10, and specifically the resiliently compressible body 13 thereof, does not include any firestop material. By this is meant that in such embodiments resiliently compressible body 13 does not comprise any substance that is an intumescent, endothermic, and/or ablative firestop material as these terms are commonly understood by the ordinary artisan. However, in some embodiments, body 13 might comprise e.g. a flame-retardant additive (or might be comprised of a polymeric material that is at least somewhat inherently flame-retardant).

The above discussions make it clear that the herein-described arrangements allow apparatus 1 and sleeve 20 thereof to be provided with airflow-blocking elements that are separate and independent from e.g. any intumescent firestop materials of apparatus 1/sleeve 20. It will be appreciated that such arrangements can advantageously allow materials and configurations of the airflow-blocking elements to be advantageously chosen to enhance the blocking of airflow as described herein, while also allowing the materials and configuration of any intumescent firestop material (e.g., an intumescent pad 130) to be advantageously chosen to enhance the ability of the firestop material to e.g. expand in the event of exposure to high temperatures. This is in contrast to designs in which one or more elements must serve in an airflow-blocking capacity and must also possess intumescent expandability. That is, the arrangements disclosed herein allow the airflow-blocking function of elements 10/210 etc. to be advantageously decoupled from e.g. an intumescently-expanding function of a firestop pad 130.

As seen e.g. in FIG. 2, in some embodiments resiliently compressible body 13 may comprise a plurality of sections 16. Resiliently compressible body 13 may be oriented with respect to elongated, open-ended sleeve 20 (as shown e.g. in FIG. 3) so that sections 16 are spaced generally along the transverse axis of elongated, open-ended sleeve 20, with each section 16 of resiliently compressible body 13 extending generally along the transverse axis of elongated, open-ended sleeve 20 and being at least partially separated from a transversely adjacent section of body 13 by a slit 15 that extends generally, substantially, or completely through the thickness of body 13 (e.g., in a direction at least generally aligned with the actuation axis of body 13). In some embodiments, no such slits may be present. In various alternative embodiments, a slit 15 may extend from mating surface 17 of resiliently compressible body 13, through at least about 40, 60, 80, 90, 95, or 100% of the thickness of body 13 (at the location of the slit). In specific embodiments, at least some slits 15 may extend entirely through the thickness of body 13.

It will be appreciated that it may be advantageous for the material of resiliently compressible body 13 to have differential compressibility, by which concept is meant the ability for a portion of body 13 to remain generally, substantially, or even completely in an uncompressed condition, even as a neighboring portion of body 13 is compressed by having an elongate tube 90 impinged thereagainst. That is, it may be advantageous for a portion of resiliently compressible body 13 of first airflow-blocking element 10 that is not impinged upon by an elongate tube 90, to remain in an uncompressed condition so that mating surface 17 of that portion of body 13 can remain at least closely abutted to (e.g., in contact with), a mating surface 217 of second airflow-blocking element 210. The presence of slits 15 can enhance this ability. (It will also be appreciated that such a slit may allow an elongate tube 90 of sufficiently small diameter to wedge at least somewhat into the slit, which might also enhance the blocking of airflow.)

In some embodiments, this differential compressibility may be used (e.g., in combination with a biasing force that is applied to at least first airflow-blocking element 10) to achieve a particularly advantageous arrangement. Specifically, with first and second airflow-blocking elements 10 and 210 in the closed position with at least one elongate tube 90 passing between particular transverse portions of resiliently compressible bodies 13 and 213 thereof, first airflow-blocking element 10 may be pressed toward second airflow-blocking element 210 so that the mating surface 17 of a portion of first body 13 that transversely neighbors the portion of first body 13 that elongate tube 90 contacts, may at least closely abut the mating surface 217 of a portion of second body 213 that transversely neighbors the portion of second body 213 that elongate tube 90 contacts. That is, in such embodiments the mating surfaces of resiliently compressible bodies 13 and 213 may remain at least closely abutting or even in contact with each other in areas wherein no elongate tube passes therebetween, even though in transversely neighboring areas of the bodies, the material of bodies 13 and 213 may have been compressed to accommodate an elongate tube therebetween.

As mentioned, at least first airflow-blocking element 10 comprises a first resiliently compressible body 13, which first body 13 comprises a first mating surface 17 that can be at least closely abutted to a second mating surface 217 of a second airflow-blocking element 210. Second airflow-blocking element 210 can have any suitable structure and shape, whether movable or non-movable. For example, in some embodiments second element 210 may take the form of a non-movable dam that extends transversely e.g. across substantially all of the transverse extent of sleeve 20, at a location proximate first open end 21 of sleeve 20, and that extends toward first element 10 and presents a second mating surface 217 against which first mating surface 17 of first element 10 can be at least closely abutted. In specific embodiments, second airflow-blocking element 210 may comprise a second resiliently compressible body 213 (which in various embodiments may be e.g. similar or identical to first resiliently compressible body 13 of first element 10). In some embodiments, second airflow-blocking element 210 may be movable in similar or identical manner to first element 10 (as exemplified by the designs of FIGS. 1-4). Thus, in such embodiments, the descriptions provided above with respect to first element 10, may be applied as well to second element 210.

In embodiments in which both first airflow-blocking element 10 and second airflow-blocking element 210 each comprise a resiliently compressible body, the mating surfaces between the two resiliently compressible bodies may be chosen as desired. For example, FIGS. 1-4 all depict an exemplary embodiment in which resiliently compressible body 13 of first element 10, and resiliently compressible body 213 of second element 210, contact each other to provide mating surfaces (i.e., contact areas on each body) that are each more or less in the form of a straight line (extending generally across the transverse width of sleeve 20) that only extends a very short distance (e.g., less than about 4, 3, or 2 mm) in a direction aligned with the long axis of sleeve 20. Such a design is shown in side view in FIG. 5 (with elements 10 and 210 in the closed position), and can be compared and contrasted to the designs of FIGS. 6 and 7. In embodiments of the general type depicted in FIG. 6, mating surfaces 17 and 217 can each extend for a longer distance (e.g., 4, 8, 12, or 16 mm) in a direction aligned with the long axis of sleeve 20.

The profile of forward surface 51 of body 13 of element 10, and the profile of rearward surface 52 of body 13 of element 10, can also be varied as desired. Thus in designs of the general type shown in FIG. 5, when element 10 is in the closed position forward surface 51 is at least generally planar and is orthogonal to the transverse axis and long axis of sleeve 20. Rearward surface 52 is also at least generally planar, but is forwardly sloped (again, when element 10 is in the closed position). The exemplary design of FIG. 6 is somewhat similar. However, in the exemplary embodiment of FIG. 7, both forward surface 51 and rearward surface 52 are rounded as they approach mating surface 17.

Figure 5:
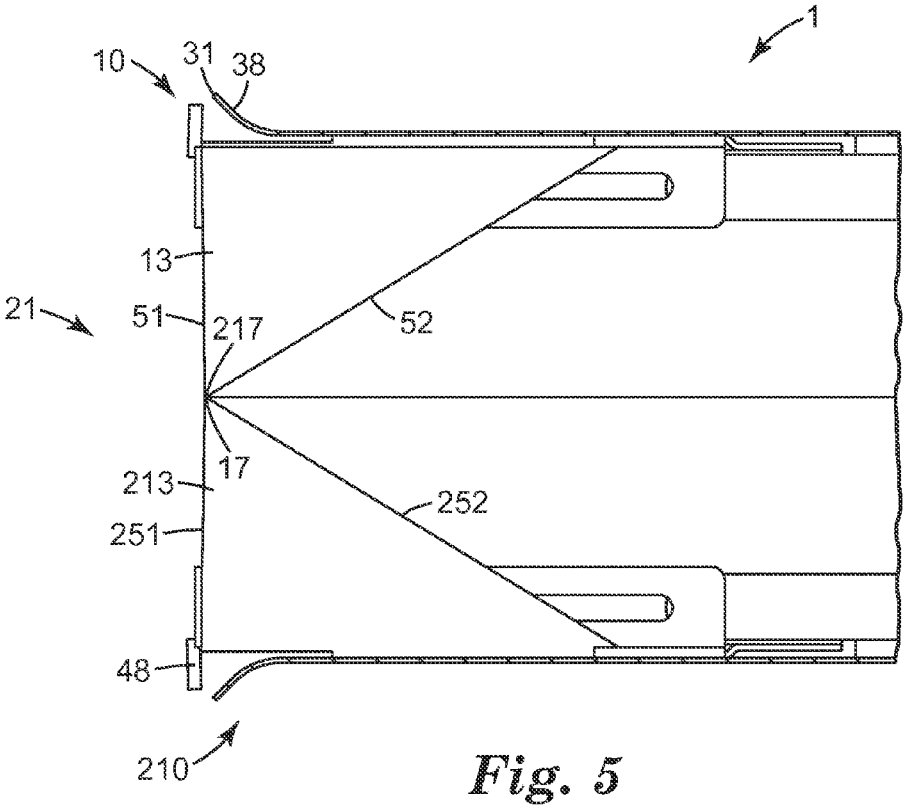
FIG. 5 is a side plan view in cutaway of a portion of an exemplary firestopping apparatus.
Figure 6:
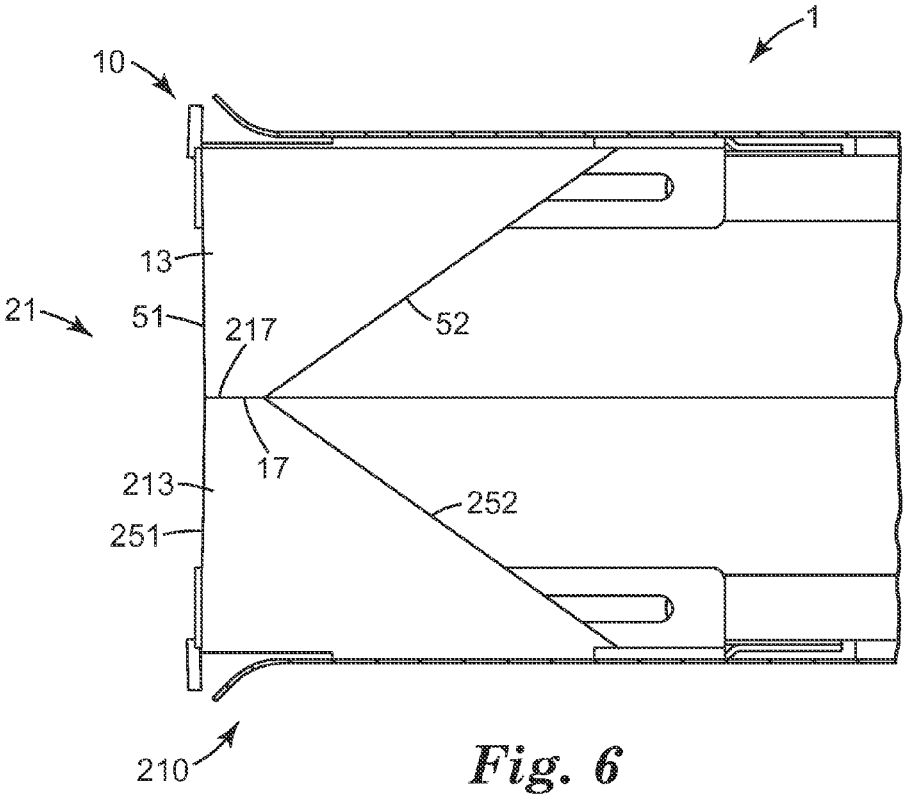
FIG. 6 is a side plan view in cutaway of a portion of another exemplary firestopping apparatus.
Figure 7:
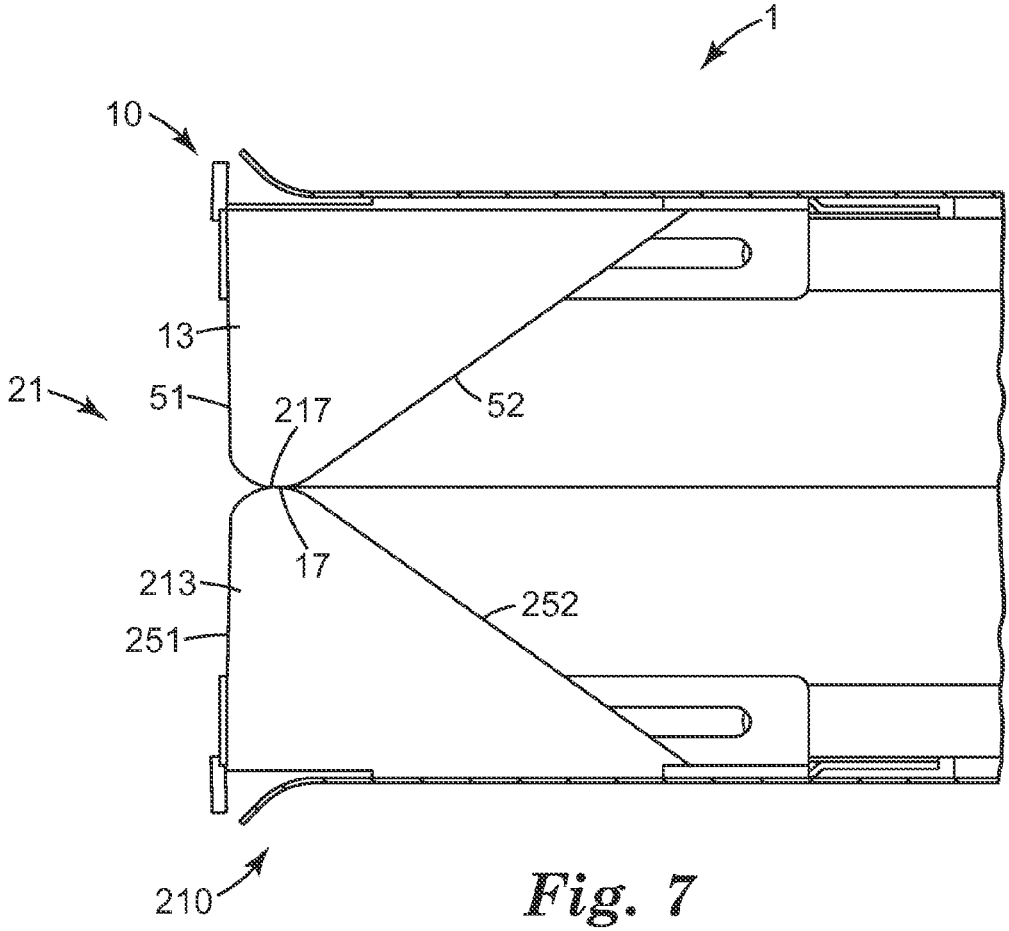
FIG. 7 is a side plan view in cutaway of a portion of another exemplary firestopping apparatus.

In the exemplary designs of FIGS. 5-7, first and second airflow-blocking elements 10 and 210 are at least generally symmetrically designed; that is, second resiliently compressible body 213 of second element 210 has a similar (albeit mirror image) profile to that of first resiliently compressible body 13. However, this is not necessary, and the two bodies can be designed in any suitable manner. It will be appreciated that designs in which the forward and rearward major surfaces of resiliently compressible body 13 and/or 213 are sloped and/or rounded (particularly in areas proximate their respective mating surfaces) may provide certain advantages. Specifically, in such embodiments (as exemplified e.g. by the design of FIG. 7), the impinging of an elongate tube 90 on frontward surface 51 and/or 251 (if elongate tube 90 is passed through open end 21 of sleeve 20 from the forward side); or, the impinging of an elongate tube 90 on rearward surface 52 and/or 252 (if elongate tube 90 is passed through open end 21 of sleeve 20 from the rearward side), may help urge first and/or second airflow-blocking elements 10/210 toward a more open position, which can make it easier for elongate tube(s) 90 to be passed therebetween. Thus, in various embodiments any or all of the forward and rearward surfaces of resiliently compressible bodies 13 and 213 may be sloped and/or rounded to aid in such effects.

It will be appreciated that the geometric design (profile) of e.g. surfaces 51, 52 of first resiliently compressible body 13 (and in particular how the surfaces intersect each other), are not the only variables that affect mating surface 17. Specifically, the force with which elements 10 and 210 are pressed towards each other may affect mating surface 17. That is, even with designs of the general type shown in FIG. 4 (with surfaces 51 and 52 of body 13 meeting to form a relatively sharp point in the absence of any significant force applied to that portion of body 13), if elements 10 and 210 are pressed together with sufficient force, the surfaces of the first and second resiliently compressible bodies of the respective airflow-blocking elements may be compressed against each other e.g. so that the mating surfaces 17 and 217 take a form more like that shown in FIG. 6 than that shown in FIG. 5. Thus, the force with which bodies 13 and 213 are pressed against each other, as well as any physical stops or limits to the respective movement of elements 10 and 210 along actuation axis $A_a$, can be adjusted as desired.

In some embodiments, mating surface 17 of airflow-blocking element 10 (e.g., as provided by a major surface of resiliently compressible body 13) may be generally linear along the transverse axis of element 10. In other embodiments, mating surface 17 may be non-linear along this axis. For example, mating surface 17 of element 10, and mating surface 217 of element 210, may comprise complementary (mating) scalloped or undulating patterns extending e.g. generally along their respective transverse axes.

Figure 8:
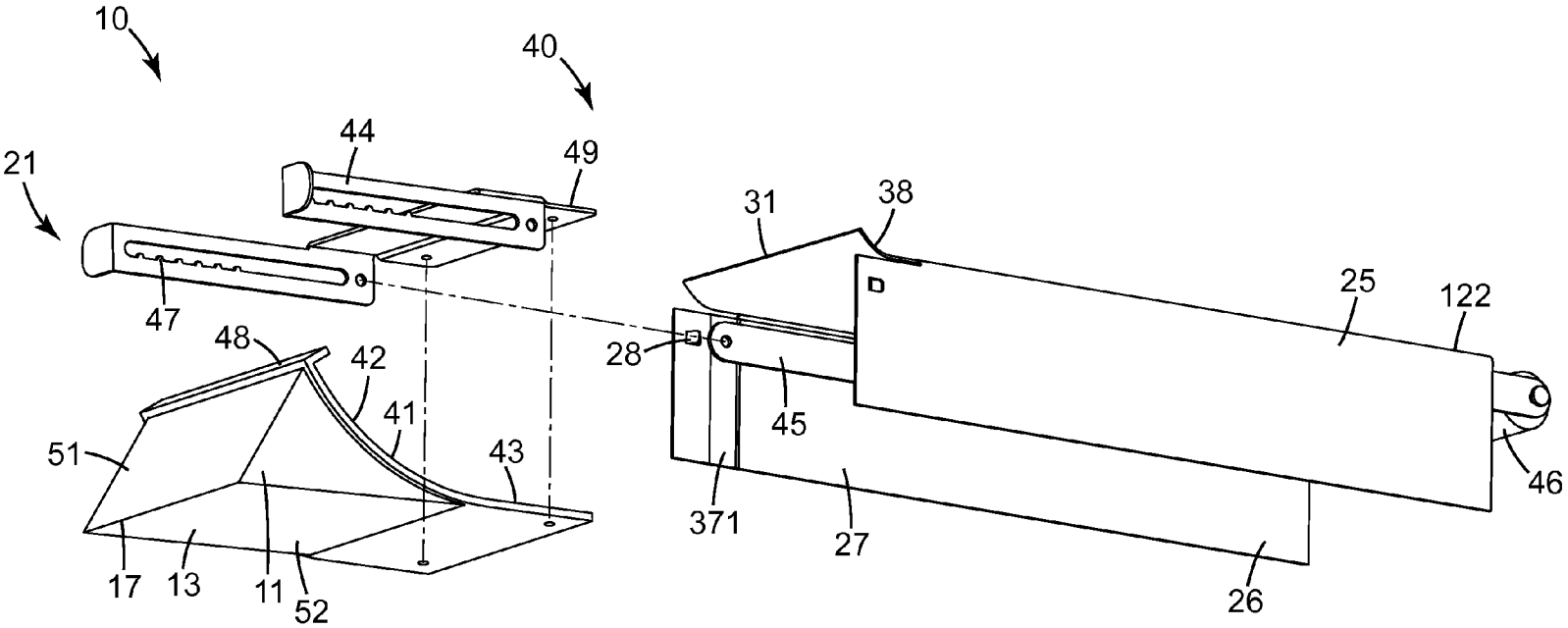
FIG. 8 is a side-front perspective exploded view in cutaway of another exemplary firestopping apparatus.

Further details of an exemplary apparatus as disclosed herein are shown in FIG. 8, which shows an exploded view of an exemplary first airflow-blocking element 10 and a corresponding portion of sleeve 20. In the illustrated embodiment, resiliently compressible body 13 is supported by biasing sheet 41 (to which body 13 may be bonded by any convenient method, including e.g. adhesive bonding or the like). Biasing sheet 41 can be made of any material that can be provided with an inherent bias (that is, an inherent tendency to curl (upwards, in the view of first element 10 in FIG. 8)). Suitable materials may include e.g. a polymeric material that is molded as an arcuately-curved sheet, to which arcuate shape the material will attempt to return if forced flat. Suitable materials may also include e.g. spring steel or the like.

Biasing sheet 41 may be oriented to bias resiliently compressible body (i.e., at least mating surface 17 thereof) to move away from mating surface 217 of second resiliently compressible body 213 (which biasing direction will be referred to as an "outward" direction herein). In aid of this, in some embodiments biasing sheet 41 may comprise a first (forward) portion 42, and a second (rearward) portion 43, which rearward portion may extend rearward past the rear edge of body 13 as shown in FIG. 8. Rearward portion 43 of biasing sheet 41 may be attached to support plate 49 (which may be made of any e.g. metal or plastic with sufficient strength). Support plate 49 may be positioned so that at least a forward part of first portion 42 of biasing sheet 41, and at least a forward portion of body 13, extend forwardly beyond the forward edge of support plate 49. Such a provision may allow forward portion 42 of biasing sheet 41 and the portion of body 13 attached thereto, to deflect (upwards, in the view of FIG. 8) unless restrained by some force, while the rearward portion 43 of biasing sheet 41 may remain undeflected. Siderails 44 may be provided that are attached to support plate 49 and that are also connected to pushrods 45, and that may serve to support and/or protect resiliently compressible body 13. In some embodiments siderails 44 may be generally rigid (e.g., made of metal). In such a case, however, a forward portion of siderails 44 should not be attached to biasing sheet 41 or to body 13, in order that sheet 41 and body 13 can deflect away from siderails 44, as evident in FIG. 4. However, in some embodiments siderails 44 may be comprised of a sufficiently deflectable material (so that siderails 44 can deflect along with sheet 41 and body 13), in which case forward portions of siderails 44 may be attached to e.g. sheet 41, to provide additional support. If desired, serrations 47 can be spaced along slots of siderails 44, which serrations may impinge on post 28 of sleeve 20 so that siderails 44 can be moved forward/rearward into a desired position and then held there as desired. If desired, one or more gaskets 371 can be provided along transverse sidewalls 25 and 26 of sleeve 20 (with only the gasket on sidewall 26 being visible in FIG. 8), which gaskets may e.g. fill any space between sidewalls 25/26 and first and second transverse ends 11 and 12 of airflow-blocking element 10. (In such case, gaskets 371 may thus be considered to be the surface of sleeve 20 to which a transverse end of element 10 may be at least closely abutted). In general, such gaskets or space-filling materials may be provided as desired between any two proximate surfaces of any component or components of apparatus 1.

It is emphasized that the use of a biasing (backing) sheet is only one exemplary way in which at least a portion of a resiliently compressible body of an airflow-blocking element can be motivated back and forth (toward and away from a second airflow-blocking element). Other methods and arrangements may be used if desired. For example, an airflow-blocking element might have a backing sheet e.g. somewhat resembling sheet 41, but being flexible with no particular bias. Or, no such backing sheet might be present. In either case, one or more guides, rails, ramps or the like may be provided on sleeve 20 that urge at least a portion of the resiliently compressible body of a first airflow-blocking element away from a second airflow-blocking element as the first element is moved forward, and that perform the reverse as the element is moved rearward. Still other ways of accomplishing such ends are discussed below with regard to FIG. 9.

As noted herein, in some embodiments the manipulation of handle(s) 46 may be the primary method by which first element 10 (and second element 210, if it is movable) are moved. In some embodiments, a user of apparatus 1 may assist in the moving of at least portions of resiliently compressible bodies 13 and 213 away from each other along actuation axis $A_a$ (e.g., by grasping some portion of element 10 and/or element 210 and urging the two elements apart). In some embodiments, the impinging of at least one elongate tube 90 onto a surface of resiliently compressible body 13 of first airflow-blocking element 10 may likewise assist in such moving. For example, a user may e.g. manipulate handle(s) 46 to place first and second airflow-blocking elements 10 and 210 into an at least partially open position; and, the user may then further separate resilient bodies 13 and 213 by hand, Or, bodies 13 and 213 may be further separated merely by the force of an elongate tube 90 impinging on a surface thereof.

If desired, apparatus 1 may comprise a catch (e.g., latch) so that first airflow-blocking element 10 can be held away from second airflow-blocking element 210 (e.g., can be held in an open position in which an elongate tube can be more easily passed through open end 21 of sleeve 20). Such a catch can then be released when it is desired to close first element 10 back toward second airflow-blocking element 210 (i.e., toward a closed position).

It will be appreciated that in many embodiments the urging of first element 10 toward a closed position may occur primarily or completely as a consequence of moving first element 10 (and second element 210 if it is likewise movable) rearward along the long axis of sleeve 20. That is, the impinging of the backside of first element 10 on forward end 31 of primary sidewall 23 as first element 10 is retracted into open end 21 of sleeve 20, will cause first element 10 to be urged into the closed position and to be held there. (If desired, a catch may be used to augment the securing of first element 10 in the closed position). Similar considerations apply to second airflow-blocking element 210 if it is likewise movable.

With this in mind, the profile of the forward end 31 of first primary sidewall 23 can be advantageously designed to facilitate the urging of first element 10 toward the closed position. Thus in embodiments of the type shown in FIG. 8, forward end 31 can be outwardly curved so that, as element 10 is moved rearward, a rearmost surface of element 10 (e.g., the backside of sheet 41) contacts forward end 31 (e.g., the inside surface thereof) of primary sidewall 23 e.g. at a tangent angle, e.g. so as to minimize any frictional resistance or snagging of element 10 on the forwardmost edge of forward end 31 of sidewall 23. Whether or not forward end 31 is outwardly curved in this manner, first element 10 may include an airflow shield 48 (as seen e.g. in FIG. 3) which may serve to prevent or minimize any airflow from passing between biasing sheet 41 and primary sidewall 23. In some embodiments, airflow shield 48 may be integrally formed with biasing sheet 41.

As disclosed herein, first element 10 (and second element 210, if movable) may be slidably moved rearward along the long axis of sleeve 20 so as to place the elements into a closed position, e.g. as in FIGS. 2 and 3. If desired, features may be included that allow confirmation that such slidable moving has been adequately (e.g., fully) completed. For example, one or more mating features (e.g. detents, serrations, etc) may be provided e.g. in some (moving) part of first element 10 (e.g., in a pushrod, siderail, biasing sheet, etc.), and in some non-moving part of apparatus 1 (e.g., in a sidewall of sleeve 20). These mating features may be arranged so that a user may receive a physical sensation or sound (e.g. a click) confirming that first element 10 has been moved a desired extent along the long axis of sleeve 20. Or, one or more latches may be provided that can only be latched when the element(s) is in the closed position.

Other provisions may be used to allow remote monitoring to confirm that element 10 (and 210 if movable) is in the closed position. For example, in some embodiments one or more indicia may be provided (e.g., on the backside of element 10) that, if visible, indicate that element 10 has not been moved rearward along the long axis of sleeve 20 to the desired extent. Such indicia may comprise e.g. any e.g. bright or colorful marker. In particular embodiments, such indicia may comprise a retroreflective material so that e.g. directing a laser pointer onto apparatus 1 will reveal that the indicia is visible. Such arrangements may allow apparatus 1 to be verified even if placed in a location in which it is not physically accessible. It is noted that in some embodiments, at least a portion of first airflow-blocking element 10 may protrude outward along the long axis of sleeve 20 past first open end 21 of sleeve 20, regardless of the position of first airflow-blocking element 10 along the long axis of sleeve 20 and/or along the actuation axis $A_a$ of element 10 (that is, even with element 10 in the closed position). However, such arrangements should not allow the indicia to be visible when element 10 is in the closed position.

Figure 9:
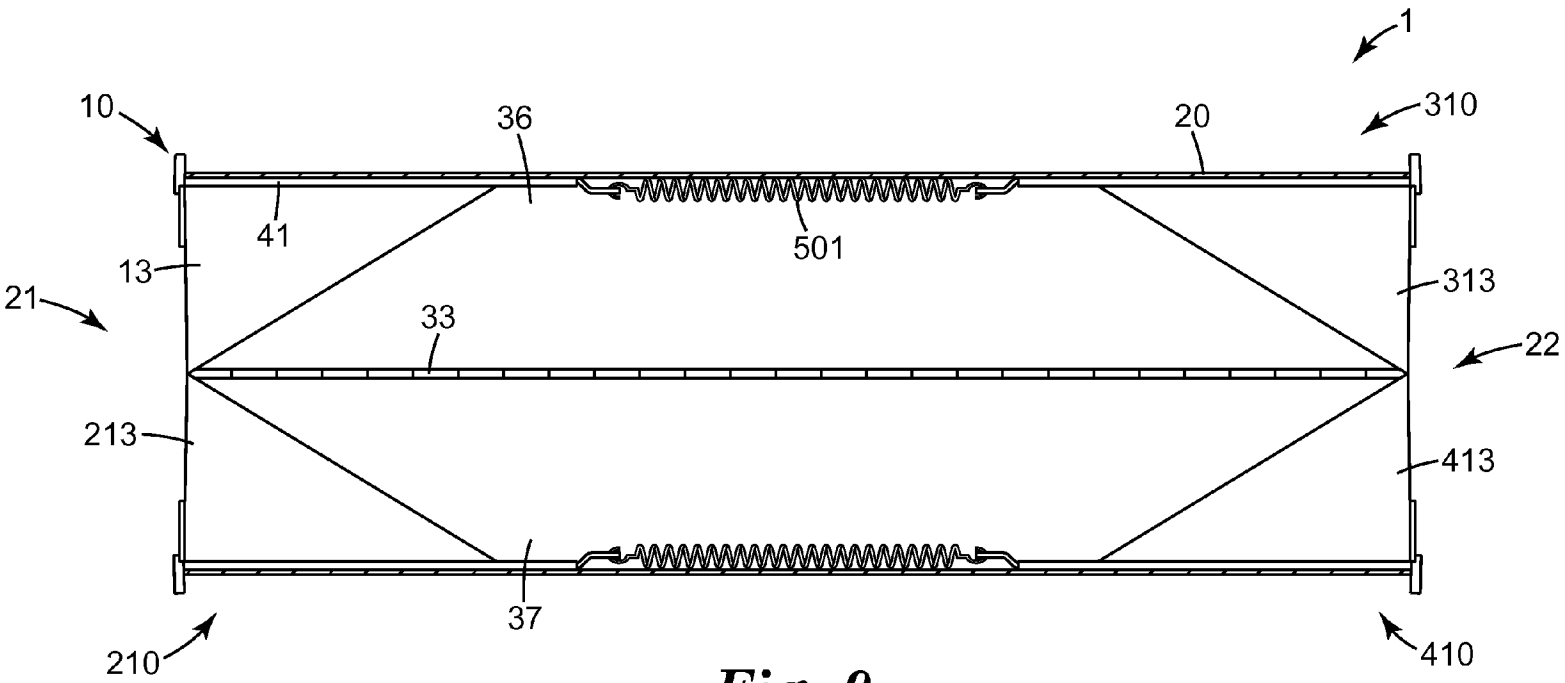
FIG. 9 is a side plan view in cutaway of another exemplary firestopping apparatus.

FIG. 9 depicts another exemplary apparatus 1 in side plan view, with near sidewall 25 omitted for clarity. In FIG. 9, first airflow-blocking element 10 and second airflow-blocking element 210 can each be moved forward and rearward along the long axis of sleeve 20, and can be urged toward each other along an actuation axis. Apparatus 1 as pictured in FIG. 9 also comprises third and fourth airflow-blocking elements 310 and 410 that are arranged proximate second open end 22 of sleeve 20. (In the depicted embodiments, elements 310 and 410 are essentially identical to elements 10 and 210, but they do not have to be). Third and fourth airflow-blocking elements 310 and 410 likewise can each be moved forward and rearward along the long axis of sleeve 20, and can be urged toward each other along an actuation axis.

In the embodiment depicted in FIG. 9, each of airflow-blocking elements 10, 210, 310 and 410 is biased (by biasing members 501) toward the long-axis centerpoint of sleeve 20. With such arrangements, first element 10 can be manually moved forward, at least partially out of open end 21 of sleeve 20, as can second element 210. This allows first and second elements 10 and 210 to be separated into an open position so as to insert at least one elongate tube 90 therebetween. (If desired, a catch can be provided so that each element can be held in an open position without active support by the user). The two elements can then be moved rearward into open end 21, which will cause them to approach each other (that is, to move toward a closed position as discussed earlier herein). Similar considerations hold for third and fourth elements 310 and 410.

The design of FIG. 9 can thus be considered to fall into the general arrangement in which a first airflow-blocking element is slidably movable in a first direction generally along the long axis of the open-ended sleeve toward a long-axis centerpoint of the open-ended sleeve, which moving of the first airflow-blocking element in the first direction generally along the long axis of the open-ended sleeve causes at least a resiliently compressible body of the first airflow-blocking element to be urged in a first direction along an actuation axis, toward a first, blocking position in which a first mating surface of the resiliently compressible body is proximate to a second mating surface of the second airflow-blocking element. Similarly, such a design can be considered to fall into the general arrangement in which a first airflow-blocking element is slidably movable in a second direction that is generally opposite the first direction, away from the long-axis centerpoint of the open-ended sleeve, which moving of the first airflow-blocking element in the second direction generally along the long axis of the open-ended sleeve, causes at least the resiliently compressible body of the first airflow-blocking element to be urged in a second direction along the actuation axis, toward a second, open position in which the first mating surface of the resiliently compressible body is separated from the second mating surface of the second airflow-blocking element.

In such approaches, it will be appreciated that the combined thickness (along the actuation axis) of first and second resiliently compressible bodies 13 and 213 (and of any backing sheet present thereon) may be chosen in relation to the distance between primary sidewalls 23 and 24 of sleeve 20 (or the distance between any components protruding inward therefrom) so that as first and second elements 10 and 210 are moved in the first direction (deeper into sleeve 20), appropriate force develops so as to e.g. press mating surfaces 17 and 217 together to a desired amount. It will also be appreciated that such approaches may be used if only two such elements, at one open end of sleeve 20, are used. However, in the illustrated embodiment, two more elements, at the opposite end of sleeve 20, are used. It will still further be appreciated that each such element might be biased by a biasing member (e.g., any suitable spring of any type) that connects the element to some part of sleeve 20. However, in the illustrated embodiment, two elements form a pair (10/210, and 310/410) in which each element is co-biased towards each other. That is, one or more biasing members 501 connects elements 10 and 210 to each other and co-biases them both toward each other; likewise, one or more biasing members connects elements 310 and 410 and likewise co-biases them toward each other. It will be appreciated that FIG. 9 represents a general type of embodiment in which a pair of airflow-blocking elements are co-biased toward each other by the same mechanism or mechanisms (as opposed to only one element being biased, or each element being separately biased). In various embodiments, one, or both, of the elements of such a co-biased pair of elements may be able to move along the biasing axis (with the latter arrangement being depicted in FIG. 9). While third and fourth airflow-blocking elements 310 and 410 have not been described in detail herein, any of the features and properties described with regard to first airflow-blocking element 10, may also be present in any such additional airflow-blocking elements, if such additional elements are present in apparatus 1. In some embodiments, linkages (e.g., pushrods and the like) may be provided between the pairs of airflow-blocking elements e.g. so that the moving of first and second airflow-blocking elements along their actuation axis, may cause the third and fourth airflow-blocking elements to move along their actuation axis (or vice versa).

Handles 46 and pushrods 45 may be of any suitable design and made of any suitable material. Pushrods 45 may protrude generally straight outwards from second open end 22 of sleeve 20 (as in the exemplary embodiment of FIG. 2); or, they may be flared away from each other (as in the exemplary embodiment of FIG. 3). Two pushrods 45 of a particular airflow-blocking element may be supplied by a single piece (e.g. a molded piece of plastic) with a handle 46 that is integrally molded therewith and that connects the outward ends of the pushrods. Or, two separate pushrods may be used, with a separately supplied handle being attached to the outward ends of both pushrods. Any type of gripper (e.g., a resilient foam sleeve or the like) may be provided on handle 46, if desired.

Sleeve 20 may be made of any suitable material. In some embodiments, sleeve 20 may be made of metal, e.g., 16 gauge sheet steel, 18 gauge sheet steel, and so on. In some embodiments, sleeve 20 may be at least generally rectangular in cross-section (e.g., when viewed along its long axis); in specific embodiments sleeve 20 may be generally, substantially or strictly square in cross-section. However, in other embodiments sleeve 20, or at least portions thereof along the long axis of sleeve 20, may be other shapes, e.g. oval, circular, or irregular. In various embodiments, sleeve 20 may be provided in various sizes to fit various size openings in walls, and in various lengths as desired. When used in a wall opening, sleeve 20 may contain one or more elongate tubes 90 passing through interior space 32 thereof, as shown in exemplary embodiment in FIG. 1. As used herein, terms such as tube and tubing are used broadly to encompass any item or items such as wire, pipe, coaxial cable, fiber optic cable, tubing, conduit, and so on, whether carrying electricity for power, electricity for signaling, optical signals, and the like, which it might be desired to pass through an opening in a wall.

Sleeve 20 may comprise any suitable rail, guide, track, bracket or series of brackets, etc., which may facilitate the slidable moving of e.g. airflow-blocking element 10 back and forth generally along the long axis of sleeve 20. For example, any of siderail(s) 44, pushrod(s) 45, etc., may be seated in a guide or track and may be slidably moveable therealong. As mentioned one or more gaskets, weatherstrips, etc., may be used in conjunction with such components in order to minimize any air leaks caused thereby.

In some embodiments, sleeve 20 may be comprised of a single piece that is not disassemblable into two or more separate pieces, nor may any major part (i.e., sidewall) of such a single-piece sleeve be movable relative to another major part thereof. In alternative embodiments, sleeve 20 may comprise a hinge on one sidewall of sleeve 20, which hinge may be oriented generally along the long axis of sleeve 20 so that sleeve 20 can be opened and closed repeatedly as desired. Such an arrangement is shown in exemplary embodiment in FIG. 9, in which a sleeve 20 comprises first and second elongated parts 36 and 37 that are hingedly connected by hinge 33, and that comprise respective edges that can be at least closely abutted against each other (e.g., can be contacted with each other) when parts 36 and 37 are closed together clamshell-style to form sleeve 20.

Any suitable hinged connection may be used, whether such a connection allows the hingedly connected sleeve parts to be disconnected from each other or not. In some embodiments, a hinged connection may be accomplished by the placement of one or more labels on the sleeve parts 36 and 37 (in such embodiments, parts 36 and 37 may be separate pieces). Such a label (which may e.g. be adhesively attached to outer surfaces of sleeve pieces 36 and 37) may already be desired to be present, e.g. to identify the product, to provide instructions to a user, to mark an axial centerpoint, etc. For the purposes outlined herein, a label may be attached (e.g., by adhesive bonding) to outer surfaces of sleeve pieces 36 and 37, spanning a seam between the two sleeve pieces, so that the portion of the label that spans the seam functions as a hinge that allows the sleeve parts to be opened into a clamshell configuration and then reclosed, as described in further detail in U.S. Pat. No. 8,069,623 to Colwell et al., which is incorporated herein by reference in its entirety.

In some embodiments, sleeve 20 may be comprised of two (or more) sleeve pieces (e.g., sleeve pieces 121 and 122 as shown in exemplary embodiment in FIGS. 2 and 3), which sleeve pieces can be taken apart from each other and can then be mated with each other (re-assembled) to form sleeve 20. (Such sleeve pieces may be, but do not have to be, similar to each other or even identical to each other.) Any suitable design may be used for sleeve parts that are mateable to each other to form sleeve 20, and in particular any suitable design may be used for seam 29 formed by mating edges of such parts. Such a mating edge might comprise e.g. a plurality of tabs (e.g., in the manner of interlocking teeth); or, such an edge might comprise e.g. a single elongate tab of the general type illustrated in FIGS. 3-5 of U.S. Pat. No. 8,069,623. All that is needed is that the edges of two such sleeve pieces are satisfactorily mateable to each other. In some embodiments, such sleeve pieces may be somewhat similar, as in the design of FIGS. 3 and 8. That is, in such embodiments each sleeve piece might comprise two sidewalls; or each sleeve piece might provide the entirety of one sidewall and a partial portion of two neighboring sidewalls. In other embodiments, a first sleeve piece may comprise e.g. a generally C-shaped cross section (in which the sleeve piece supplies three of the four sidewalls of the sleeve), with a second sleeve piece supplying the fourth sidewall. It will be understood that many variations on such designs are possible.

It will be appreciated that hinged designs and/or multi-piece designs of sleeve 20 may be advantageous in at least some circumstances. That is, if a sleeve is to be used e.g. in the firestopping of a newly created opening in a wall (e.g., that does not contain tubing already inserted therethrough), sleeve 20 may be placed in the opening as is (that is, with a hinged sleeve in its closed position, or with a multi-piece sleeve in its assembled condition). If to be used in firestopping an opening that already contains tubing inserted therethrough, it may be necessary to open and/or at least partially disassemble sleeve 20 in order to position the tubing within sleeve 20. Thus, a sleeve may be provided with a hinged connection so that it can be momentarily opened for insertion of tubing thereinto and then reclosed clamshell-style to reform sleeve 20. Similarly, sleeve pieces may be disassembled from each other for insertion of tubing, and then reassembled to each other to reform sleeve 20.

It will be understood that the above-mentioned condition that a transverse end of an airflow-blocking element at least closely abuts a transverse sidewall of the elongated, open-ended sleeve, may be provided not only by a transverse end of a resiliently compressible cylindrical sleeve of the airflow-blocking element, but also could be provided by some other component of the airflow-blocking element, e.g. by a siderail 44 as described herein. And, in more general terms, any suitable gasket, weatherstrip, member, or space-filling material may be provided in at least a portion of a space between any two proximate portions of any components of apparatus 1, e.g. in order to minimize the passage of air through that space. Thus, the herein-described condition of at least closely abutting, or contacting, a surface of a component or portion of apparatus 1 (e.g., a sidewall of sleeve 20) broadly encompasses any situation in which such a surface is a surface of e.g. a protrusion, dam, gasket, etc., that extends from a component or portion of e.g. sleeve 20. In particular, such a gasket, weatherstrip or the like may be provided between any two surfaces that are movable relative to each other, as exemplified by gasket 371 depicted in FIG. 8 and discussed earlier herein.

It will also be appreciated that the provision that two surfaces may e.g. at least closely abut each other, may not be required if there is no possibility of unacceptable air leakage between the two surfaces. Still further, such a provision may not necessarily be required between every two surfaces, e.g. if the collective air leakage between all such surfaces is sufficiently small e.g. so that the total airflow through apparatus 1 is sufficiently low. Such an overall airflow can be characterized e.g. in terms of an L rating, which will be well known to those of ordinary skill. Such an L rating can be obtained by testing apparatus 1 in generally similar manner as outlined in UL Test Procedure 1479, in which an air pressure differential of approximately 75 Pa (0.3 inches of water) is applied to apparatus 1 and the volume of airflow therethrough is measured. In various embodiments, apparatus 1 may comprise an L rating of less than about 50, 20, 10, 5, 2, or 1 cubic foot per minute of airflow per square foot.

It is noted that in many of the embodiments illustrated and discussed herein, a portion of first airflow-blocking element 10 may protrude outwardly (away from second airflow-blocking element 210) beyond primary sidewall 23 of sleeve 20 when first airflow-blocking element 10 is moved to a fully open position. In view of this, apparatus 1 may be conveniently positioned within a through-penetrating opening 83 of wall 80, so that first end 21 of sleeve 20 protrudes sufficiently far away from wall 80 that wall 80 does not prevent airflow-blocking element 10 (or any such element) from moving. Similarly, if any cover plate is used to mount sleeve 20 to wall 80, such a cover plate can be positioned so as to not prevent any airflow-blocking element from moving (e.g., as shown in FIG. 1).

In some embodiments, no component (excepting any cover plate 140 as might be optionally used) of apparatus 1 extends or protrudes transversely outward past a transverse sidewall of sleeve 20. (Such an arrangement may be advantageous if it is desired to abut multiple apparatus 1's closely together.) In some embodiments, no part of the resiliently compressible body of the first airflow-blocking element is attached (directly or indirectly) to elongated, open-ended sleeve 20 so that it cannot move relative thereto. Also, a sleeve as disclosed herein does not necessarily have to exhibit a square, or even rectangular cross-section, throughout the entire elongated length of the sleeve or even at any particular location along the elongated length of the sleeve. In the case of a sleeve with e.g. an oval, irregular, or even circular cross-section, such a sleeve can still be provided with first and second airflow-blocking elements (and third and fourth elements, if desired) as disclosed herein. It is only needed that the elements be designed (e.g., with an arcuate or bowed shape) e.g. so that surfaces of the elements can be e.g. at least closely abutted against end portions of the sleeve, of a sealing plate, or the like.

In some embodiments, items described herein may be supplied as kits, which may include, for example one or more sleeves 20 and/or two or more sleeve pieces. Such kits may optionally include any or all of mounting plates, firestop materials (e.g. if not already supplied within sleeve 20) whether in the form of pads, putty, or the like, space-filling material, installation instructions, and so on.

An advantage of an airflow-blocking element that comprises a resiliently compressible body, (e.g., particularly a body with a rounded forward surface as shown in FIG. 7), is that the element can serve to provide a large radius of curvature for one or more elongate tubes that are passed through sleeve 20. That is, in some situations gravity may cause a portion of an elongate tube that is outward of an open end of a sleeve to droop downward, with the undesired result that the elongate tube may bend too sharply (e.g., may kink). The presence of a resiliently compressible body at the open end of the sleeve may minimize the chance of such kinking, and thus may eliminate the need to install an antikinking device (e.g., a so-called radius control module) at the open end of a sleeve.

LIST OF EXEMPLARY EMBODIMENTS

Embodiment 1

A firestopping apparatus for mounting into a through-penetrating opening in a wall, comprising: an elongated open-ended sleeve with a long axis, a transverse axis, and with first and second open ends, and which at least partially defines an interior space therein, which interior space allows passage of at least one elongate tube therethrough; and, first and second airflow-blocking elements, each of the first and second airflow-blocking elements being positioned proximate the first open end of the sleeve and extending at least generally along the transverse axis of the sleeve so as to comprise a first transverse end that is proximate a first transverse sidewall of the sleeve and a second transverse end that is proximate a second transverse sidewall of the sleeve; wherein the first airflow-blocking element is slidably movable in a first direction generally along the long axis of the open-ended sleeve toward a long-axis centerpoint of the open-ended sleeve, which moving of the first airflow-blocking element in the first direction generally along the long axis of the open-ended sleeve, urges at least a portion of a first resiliently compressible body of the first airflow-blocking element in a first direction along an actuation axis, toward a first, blocking position in which a first mating surface of the first resiliently compressible body is proximate to a second mating surface of the second airflow-blocking element; and, wherein the first airflow-blocking element is slidably movable in a second direction that is generally opposite the first direction, away from the long-axis centerpoint of the open-ended sleeve, which moving of the first airflow-blocking element in the second direction generally along the long axis of the open-ended sleeve, urges at least the portion of the first resiliently compressible body of the first airflow-blocking element in a second direction along the actuation axis, toward a second, open position in which the first mating surface of the first resiliently compressible body is separated from the second mating surface of the second airflow-blocking element.

Embodiment 2

The apparatus of embodiment 1 wherein each of the first and second airflow-blocking elements extends along the transverse axis of the sleeve so as to comprise a first transverse end that at least closely abuts a first transverse sidewall of the sleeve and a second transverse end that at least closely abuts a second transverse sidewall of the sleeve;

Embodiment 3

The apparatus of any of embodiments 1-2 wherein the first resiliently compressible body of the first airflow-blocking element is attached to, and supported by, a biasing sheet that is biased to urge the first resiliently compressible body in the second direction along the actuation axis toward the second, open position.

Embodiment 4

The apparatus of embodiment 3 wherein the biasing sheet is connected to at least one pushrod that is connected to a handle which can be grasped by an operator to slidably move the first airflow-blocking element in the first and second directions generally along the long axis of the elongated, open-ended sleeve.

Embodiment 5

The apparatus of embodiment 4 wherein the at least one pushrod extends generally along the long axis of the elongated, open-ended sleeve, so that at least a portion of the handle is positioned outwardly generally along the long axis of the sleeve from the second open end of the elongated, open-ended sleeve.

Embodiment 6

The apparatus of any of embodiments 3-5 wherein the biasing sheet comprises a second end that is proximal to the long-axis centerpoint of the elongated, open-ended sleeve and that is connected to the pushrod, and a first end that is distal to the long-axis centerpoint of the sleeve and that is proximal to the first mating surface of the first resiliently compressible body, and wherein the biasing sheet serves to urge the first mating surface of the first resiliently compressible body in the second direction along the actuation axis of the first resiliently compressible body, along an arcuate path.

Embodiment 7

The apparatus of embodiment 6 wherein when the first airflow-blocking element is in the first, blocking position the biasing sheet comprises a first configuration that is substantially planar and substantially aligned with the long axis of the elongated, open-ended sleeve, and wherein when the first airflow-blocking element is in the second, open position the biasing sheet comprises a second, generally outwardly curled configuration.

Embodiment 8

The apparatus of any of embodiments 1-7 wherein when the first airflow-blocking element is in the second, open position, a retroreflective indicia is visible on a portion of the first airflow-blocking element that protrudes outward generally along the long axis of the sleeve past the first open end of the sleeve; and, wherein when the first airflow-blocking element is in the first, closed position, the retroreflective indicia is not visible from a position outward of the interior space of the sleeve.

Embodiment 9

The apparatus of any of embodiments 1-8 wherein the first resiliently compressible body comprises a plurality of sections that are spaced generally along the transverse axis of the elongated, open-ended sleeve, each section of the first resiliently compressible body generally along this transverse axis and being separated from a transversely adjacent section of the first resiliently compressible body by a slit that extends from the first mating surface of the first resiliently compressible body, generally along the actuation axis of the first resiliently compressible body of first airflow-blocking element.

Embodiment 10

The apparatus of any of embodiments 1-9 wherein at least a portion of the first airflow-blocking element protrudes outward along the long axis of the sleeve past the first open end of the sleeve, regardless of the position of the first airflow-blocking element along its actuation axis.

Embodiment 11

The apparatus of any of embodiments 1-10 wherein at least the first airflow-blocking element is connected to the sleeve by a biasing member that serves to motivate the first airflow-blocking element in the first direction generally along the long axis of the open-ended sleeve toward the long-axis centerpoint of the open-ended sleeve.

Embodiment 12

The apparatus of any of embodiments 1-11 wherein the elongated, open-ended sleeve comprises a catch that allows the first airflow-blocking element to be held in the second, open position, which catch can be released to allow the first airflow-blocking element to move toward the first, closed position.

Embodiment 13

The apparatus of any of embodiments 1-12 wherein the second airflow-blocking element is slidably movable in a first direction generally along the long axis of the open-ended sleeve toward a long-axis centerpoint of the open-ended sleeve, which moving of the second airflow-blocking element in the first direction generally along the long axis of the open-ended sleeve, urges at least a second resiliently compressible body of the second airflow-blocking element in a first direction along the actuation axis, toward a first, blocking position in which the first mating surface of the first resiliently compressible body of the first airflow-blocking element is proximate to the second mating surface of the second resiliently compressible body of the second airflow-blocking element; and, wherein the second airflow-blocking element is slidably movable in a second direction that is generally opposite the first direction, away from the long-axis centerpoint of the open-ended sleeve, which moving of the second airflow-blocking element in the second direction generally along the long axis of the open-ended sleeve, urges at least the second resiliently compressible body of the second airflow-blocking element in a second direction along the actuation axis, toward a second, open position in which the first mating surface of the first resiliently compressible body of the first airflow-blocking element is separated from the second mating surface of the second resiliently compressible body of the second airflow-blocking element.

Embodiment 14

The apparatus of any of embodiments 1-13 further comprising third and fourth airflow-blocking elements, each of the third and fourth airflow-blocking elements being positioned proximate the second open end of the sleeve and extending at least generally along the transverse axis of the sleeve so as to comprise a first transverse end that is proximate a first transverse sidewall of the sleeve and a second transverse end that is proximate a second transverse sidewall of the sleeve; wherein the third airflow-blocking element is slidably movable in a first direction generally along the long axis of the open-ended sleeve toward a long-axis centerpoint of the open-ended sleeve, which moving of the third airflow-blocking element in the first direction generally along the long axis of the open-ended sleeve, urges at least a third resiliently compressible body of the third airflow-blocking element in a first direction along an actuation axis of the third resiliently compressible body, toward a first, blocking position in which a third mating surface of the third resiliently compressible body is proximate to a fourth mating surface of the fourth airflow-blocking element; and, wherein the third airflow-blocking element is slidably movable in a second direction that is generally opposite the first direction in which the third airflow-blocking element is movable, away from the long-axis centerpoint of the open-ended sleeve, which moving of the third airflow-blocking element in the second direction generally along the long axis of the open-ended sleeve, urges at least the third resiliently compressible body of the third airflow-blocking element in a second direction along the actuation axis, toward a second, open position in which the third mating surface of the third resiliently compressible body is separated from the fourth mating surface of the fourth airflow-blocking element.

Embodiment 15

The apparatus of embodiment 14 wherein the first and third airflow-blocking elements are co-biased toward each other and toward the long-axis centerpoint of the elongated, open-ended sleeve, by at least one co-biasing member that is connected to the first and third airflow-blocking members and that urges them toward each other.

Embodiment 16

The apparatus of any of embodiments 1-15 wherein upon passing an elongate tube through the first end of the elongated, open-ended sleeve so that the elongate tube is in contact with a first transverse portion of the first mating surface of the first resiliently compressible body of the first airflow-blocking element and is in contact with a second transverse portion of the second mating surface of the second resiliently compressible body of the second airflow-blocking element, a third transverse portion of the first mating surface of the first resiliently compressible body, which third transverse portion transversely neighbors the first transverse portion of the first mating surface of the first resiliently compressible body that the elongate tube is in contact with, at least closely abuts a fourth transverse portion of the second mating surface of the second resiliently compressible body of the second airflow-blocking element, which fourth transverse portion of the second mating surface of the second resiliently compressible body transversely neighbors the second transverse portion of the second mating surface of the second resiliently compressible body that the elongate tube is in contact with.

Embodiment 17

The apparatus of any of embodiments 1-16 wherein the sleeve is provided in the form of first and second elongated parts that are connected to each other by a hinged connection that is at least generally aligned with the long axis of the sleeve and that extends along at least a portion of the elongate length of the sleeve; wherein the first and second elongated parts each comprise an edge, which edges of the first and second elongated parts are at least closely abuttable against each other; and, whereby the sleeve comprises a clamshell design in which the first and second elongated parts can be hingedly rotated into an open configuration and can be hingedly rotated into a closed configuration in which the edges of the first and second elongated sleeve parts are at least closely abutted against each other.

Embodiment 18

The apparatus of any of embodiments 1-17 wherein the sleeve is provided in the form of first and second elongated pieces that are separable from each other and that are mateable to each other to form the sleeve.

Embodiment 19

The apparatus of any of embodiments 1-18 wherein at least the first airflow-blocking element does not include any firestop material.

Embodiment 20

The apparatus of any of embodiments 1-19 wherein no airflow-blocking element of the apparatus includes any firestop material.

Embodiment 21

The apparatus of any of embodiments 1-20 wherein the sleeve further comprises at least one intumescent sheet that is abutted against a major inside surface of a sidewall of the sleeve.

Embodiment 22

A method of firestopping a through-penetration in a wall, the method comprising mounting the apparatus of any of embodiments 1-21 in the through-penetration.

Embodiment 23

The method of embodiment 22, further comprising passing at least one elongate tube through the elongate length of the open-ended sleeve of the apparatus so that the elongate tube extends out of the first and second open ends of the open-ended sleeve.

It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention not merely those representative designs that were chosen to serve as exemplary illustrations. Thus, the scope of the present invention should not be limited to the specific illustrative structures described herein, but rather extends at least to the structures described by the language of the claims, and the equivalents of those structures. To the extent that there is a conflict or discrepancy between this specification as written and the disclosure in any document incorporated by reference herein, this specification as written will control.

What is claimed is:

1. A firestopping apparatus for mounting into a through-penetrating opening in a wall, comprising:

an elongated open-ended sleeve with a long axis, a transverse axis, and with first and second open ends, and which at least partially defines an interior space therein, which interior space allows passage of at least one elongate tube therethrough; and, first and second airflow-blocking elements, each of the first and second airflow-blocking elements being positioned proximate the first open end of the sleeve and extending at least generally along the transverse axis of the sleeve so as to comprise a first transverse end that is proximate a first transverse sidewall of the sleeve and a second transverse end that is proximate a second transverse sidewall of the sleeve;

wherein the first airflow-blocking element is slidably movable in a first direction generally along the long axis of the open-ended sleeve toward a long-axis centerpoint of the open-ended sleeve, which moving of the first airflow-blocking element in the first direction generally along the long axis of the open-ended sleeve, urges at least a portion of a first resiliently compressible body of the first airflow-blocking element in a first direction along an actuation axis, toward a first, blocking position in which a first mating surface of the first resiliently compressible body is proximate to a second mating surface of the second airflow-blocking element; and, wherein the first airflow-blocking element is slidably movable in a second direction that is generally opposite the first direction, away from the long-axis centerpoint of the open-ended sleeve, which moving of the first airflow-blocking element in the second direction generally along the long axis of the open-ended sleeve, urges at least the portion of the first resiliently compressible body of the first airflow-blocking element in a second direction along the actuation axis, toward a second, open position in which the first mating surface of the first resiliently compressible body is separated from the second mating surface of the second airflow-blocking element.

2. The apparatus of claim 1 wherein each of the first and second airflow-blocking elements extends along the transverse axis of the sleeve so as to comprise a first transverse end that at least closely abuts a first transverse sidewall of the sleeve and a second transverse end that at least closely abuts a second transverse sidewall of the sleeve.

3. The apparatus of claim 1 wherein the first resiliently compressible body of the first airflow-blocking element is attached to, and supported by, a biasing sheet that is biased to urge the first resiliently compressible body in the second direction along the actuation axis toward the second, open position.

4. The apparatus of claim 3 wherein the biasing sheet is connected to at least one pushrod that is connected to a handle which can be grasped by an operator to slidably move the first airflow-blocking element in the first and second directions generally along the long axis of the elongated, open-ended sleeve.

5. The apparatus of claim 4 wherein the at least one pushrod extends generally along the long axis of the elongated, open-ended sleeve, so that at least a portion of the handle is positioned outwardly generally along the long axis of the sleeve from the second open end of the elongated, open-ended sleeve.

6. The apparatus of claim 3 wherein the biasing sheet comprises a second end that is proximal to the long-axis centerpoint of the elongated, open-ended sleeve and that is connected to the pushrod, and a first end that is distal to the long-axis centerpoint of the sleeve and that is proximal to the first mating surface of the first resiliently compressible body, and wherein the biasing sheet serves to urge the first mating surface of the first resiliently compressible body in the second direction along the actuation axis of the first resiliently compressible body, along an arcuate path.

7. The apparatus of claim 6 wherein when the first airflow-blocking element is in the first, blocking position the biasing sheet comprises a first configuration that is substantially planar and substantially aligned with the long axis of the elongated, open-ended sleeve, and wherein when the first airflow-blocking element is in the second, open position the biasing sheet comprises a second, generally outwardly curled configuration.

8. The apparatus of claim 1 wherein when the first airflow-blocking element is in the second, open position, a retroreflective indicia is visible on a portion of the first airflow-blocking element that protrudes outward generally along the long axis of the sleeve past the first open end of the sleeve; and, wherein when the first airflow-blocking element is in the first, closed position, the retroreflective indicia is not visible from a position outward of the interior space of the sleeve.

9. The apparatus of claim 1 wherein the first resiliently compressible body comprises a plurality of sections that are spaced generally along the transverse axis of the elongated, open-ended sleeve, each section of the first resiliently compressible body generally along this transverse axis and being separated from a transversely adjacent section of the first resiliently compressible body by a slit that extends from the first mating surface of the first resiliently compressible body, generally along the actuation axis of the first resiliently compressible body of first airflow-blocking element.

10. The apparatus of claim 1 wherein at least a portion of the first airflow-blocking element protrudes outward along the long axis of the sleeve past the first open end of the sleeve, regardless of the position of the first airflow-blocking element along its actuation axis.

11. The apparatus of claim 1 wherein at least the first airflow-blocking element is connected to the sleeve by a biasing member that serves to motivate the first airflow-blocking element in the first direction generally along the long axis of the open-ended sleeve toward the long-axis centerpoint of the open-ended sleeve.

12. The apparatus of claim 11 wherein the elongated, open-ended sleeve comprises a catch that allows the first airflow-blocking element to be held in the second, open position, which catch can be released to allow the first airflow-blocking element to move toward the first, closed position.

13. The apparatus of claim 1 wherein the second airflow-blocking element is slidably movable in a first direction generally along the long axis of the open-ended sleeve toward a long-axis centerpoint of the open-ended sleeve, which moving of the second airflow-blocking element in the first direction generally along the long axis of the open-ended sleeve, urges at least a second resiliently compressible body of the second airflow-blocking element in a first direction along the actuation axis, toward a first, blocking position in which the first mating surface of the first resiliently compressible body of the first airflow-blocking element is proximate to the second mating surface of the second resiliently compressible body of the second airflow-blocking element; and, wherein the second airflow-blocking element is slidably movable in a second direction that is generally opposite the first direction, away from the long-axis centerpoint of the open-ended sleeve, which moving of the second airflow-blocking element in the second direction generally along the long axis of the open-ended sleeve, urges at least the second resiliently compressible body of the second airflow-blocking element in a second direction along the actuation axis, toward a second, open position in which the first mating surface of the first resiliently compressible body of the first airflow-blocking element is separated from the second mating surface of the second resiliently compressible body of the second airflow-blocking element.

14. The apparatus of claim 1 further comprising third and fourth airflow-blocking elements, each of the third and fourth airflow-blocking elements being positioned proximate the second open end of the sleeve and extending at least generally along the transverse axis of the sleeve so as to comprise a first transverse end that is proximate a first transverse sidewall of the sleeve and a second transverse end that is proximate a second transverse sidewall of the sleeve;

wherein the third airflow-blocking element is slidably movable in a first direction generally along the long axis of the open-ended sleeve toward a long-axis centerpoint of the open-ended sleeve, which moving of the third airflow-blocking element in the first direction generally along the long axis of the open-ended sleeve, urges at least a third resiliently compressible body of the third airflow-blocking element in a first direction along an actuation axis of the third resiliently compressible body, toward a first, blocking position in which a third mating surface of the third resiliently compressible body is proximate to a fourth mating surface of the fourth airflow-blocking element; and, wherein the third airflow-blocking element is slidably movable in a second direction that is generally opposite the first direction in which the third airflow-blocking element is movable, away from the long-axis centerpoint of the open-ended sleeve, which moving of the third airflow-blocking element in the second direction generally along the long axis of the open-ended sleeve, urges at least the third resiliently compressible body of the third airflow-blocking element in a second direction along the actuation axis, toward a second, open position in which the third mating surface of the third resiliently compressible body is separated from the fourth mating surface of the fourth airflow-blocking element.

15. The apparatus of claim 14 wherein the first and third airflow-blocking elements are co-biased toward each other and toward the long-axis centerpoint of the elongated, open-ended sleeve, by at least one co-biasing member that is connected to the first and third airflow-blocking members and that urges them toward each other.

16. The apparatus of claim 1 wherein upon passing an elongate tube through the first end of the elongated, open-ended sleeve so that the elongate tube is in contact with a first transverse portion of the first mating surface of the first resiliently compressible body of the first airflow-blocking element and is in contact with a second transverse portion of the second mating surface of the second resiliently compressible body of the second airflow-blocking element, a third transverse portion of the first mating surface of the first resiliently compressible body, which third transverse portion transversely neighbors the first transverse portion of the first mating surface of the first resiliently compressible body that the elongate tube is in contact with, at least closely abuts a fourth transverse portion of the second mating surface of the second resiliently compressible body of the second airflow-blocking element, which fourth transverse portion of the second mating surface of the second resiliently compressible body transversely neighbors the second transverse portion of the second mating surface of the second resiliently compressible body that the elongate tube is in contact with.

17. The apparatus of claim 1 wherein the sleeve is provided in the form of first and second elongated parts that are connected to each other by a hinged connection that is at least generally aligned with the long axis of the sleeve and that extends along at least a portion of the elongate length of the sleeve;

wherein the first and second elongated parts each comprise an edge, which edges of the first and second elongated parts are at least closely abuttable against each other; and, whereby the sleeve comprises a clamshell design in which the first and second elongated parts can be hingedly rotated into an open configuration and can be hingedly rotated into a closed configuration in which the edges of the first and second elongated sleeve parts are at least closely abutted against each other.

18. The apparatus of claim 1 wherein the sleeve is provided in the form of first and second elongated pieces that are separable from each other and that are mateable to each other to form the sleeve.

19. The apparatus of claim 1 wherein at least the first airflow-blocking element does not include any firestop material.

20. The apparatus of claim 19 wherein the sleeve further comprises at least one intumescent sheet that is abutted against a major inside surface of a sidewall of the sleeve.

* * * * *